United States Patent [19]

Powers

[11] 4,262,730

[45] Apr. 21, 1981

[54] STRIKE OFF METHOD FOR AUTOMATICALLY LEVELING AND COMPACTING SAND IN MOLD BOXES OF VARYING HEIGHTS

[75] Inventor: Earl W. Powers, Molalla, Oreg.

[73] Assignee: Dependable-Fordath, Inc., Sherwood, Oreg.

[21] Appl. No.: 113,510

[22] Filed: Jan. 21, 1980

Related U.S. Application Data

[63] Continuation of Ser. No. 967,110, Dec. 6, 1978, abandoned.

[51] Int. Cl.[3] ..... B22C 15/02; B22C 11/02

[52] U.S. Cl. ..... 164/4; 164/37; 164/154; 164/208; 164/211

[58] Field of Search ..... 164/154, 161, 194, 195, 164/207, 208, 211, 4, 37, 38; 425/218, 220; 100/168, 169, 176, 153

[56] References Cited

U.S. PATENT DOCUMENTS

| | | | |
|---|---|---|---|
| 400,893 | 4/1889 | Bird | 164/208 |
| 1,759,728 | 5/1930 | Backon | 164/208 |
| 1,828,882 | 10/1931 | Tabor et al. | 164/211 |
| 2,869,189 | 1/1959 | Pirsig | 164/154 |

FOREIGN PATENT DOCUMENTS

| | | | |
|---|---|---|---|
| 200484 | 12/1965 | Sweden | 164/208 |

*Primary Examiner*—R. L. Spruill
*Assistant Examiner*—Gus T. Hampilos
*Attorney, Agent, or Firm*—Klarquist, Sparkman, Campbell, Leigh, Hall & Whinston

[57] ABSTRACT

The specification discloses a strike off apparatus for leveling and compacting mounds of sand extending above the upper edges of open-top mold boxes of varying heights carried in succession along a pathway. A pair of pivotally supported rollers extend across the pathway. A sensor determines the height of a sand mound in a mold box before it reaches the rollers. An elevating mechanism responsive to the sensor adjusts the rollers to a height so that they level and compact the sand mound as the mold box is carried thereunder. A control system including electrical and hydraulic circuits is provided for automatically controlling the cyclical operation of the apparatus.

1 Claim, 9 Drawing Figures

FIG.4
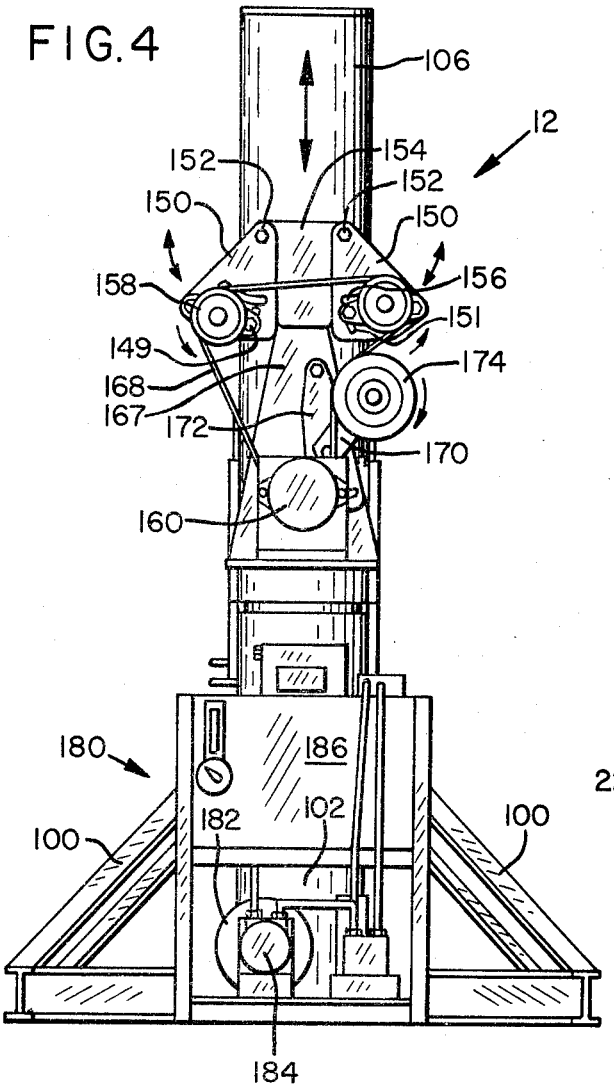
FIG.5
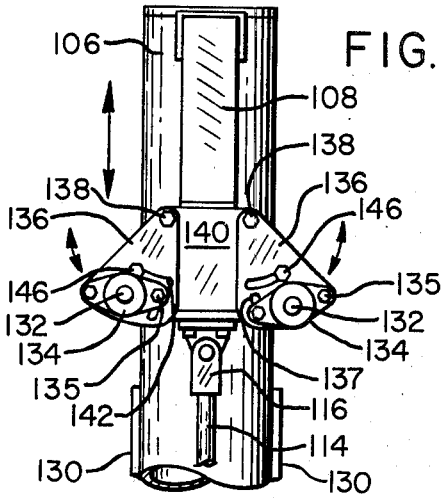
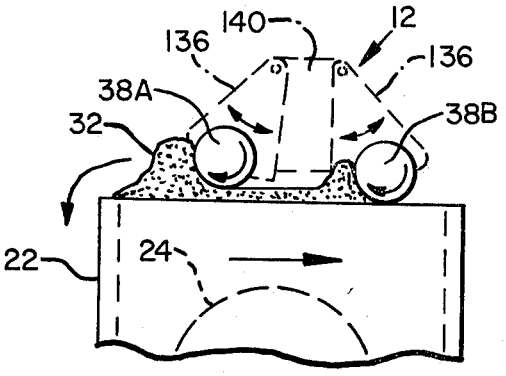
FIG.6
FIG.8
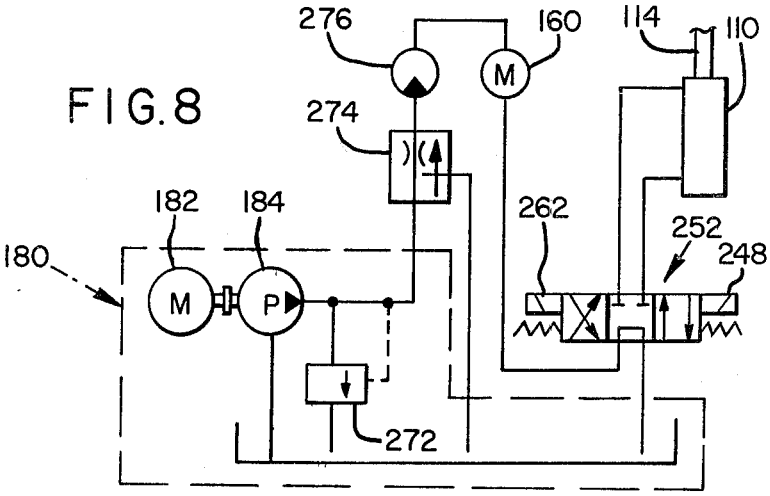

STRIKE OFF METHOD FOR AUTOMATICALLY LEVELING AND COMPACTING SAND IN MOLD BOXES OF VARYING HEIGHTS

This is a continuation of application Ser. No. 967,110, filed Dec. 6, 1978, now abandoned.

BACKGROUND OF THE INVENTION

The present invention relates to multi-station sand mold making apparatus for producing sand molds for foundry use, and more particularly to a strike off apparatus for automatically leveling and compacting sand in mold boxes of varying heights carried in succession along a pathway.

Multi-station sand mold making apparatus have been known heretofore. It is desirable that such apparatus be capable of simultaneously producing the cope (upper half) and drag (lower half) portions of a composite sand mold, the two portions being complete and assembled upon each other and ready for the molten metal pouring operation at the time they leave the apparatus. Typically, a plurality of mold boxes, each containing a mold pattern, are circulated around a closed pathway through a succession of stations at which different mold making operations are performed.

At one station a predetermined amount of sand containing a binder and a catalyst is poured into an open-top mold box. The mold box is simultaneously vibrated to eliminate voids and produce some compaction of the sand. The amount of sand which is poured into the mold box is sufficient to form a mound which extends above the upper edges of the box.

At a succeeding strike off station the sand is distributed, leveled, and slightly compacted before the binder hardens. This may be done by hand tamping, by using a ramming apparatus, by using revolving rollers, or by some other known technique. By distributing it is meant that the mound of sand is spread more or less evenly throughout the mold box. By leveling it is meant that a smooth, horizontal upper surface is imparted to the sand which usually coincides with the upper edges of the mold box. By compacting it is meant that the space between the granules of sand is reduced.

When the apparatus of the present invention is utilized at this station, voids or gaps adjacent the pattern are eliminated. This ensures a more precisely defined casting. Also, the sand is compacted to a uniform density. Without such a uniform density, regions of the completed, hardened composite sand mold can prematurely crumble or fracture when the mold is filled with molten metal. This ruins the casting. When the sand is compacted with the apparatus of the invention, the cope and drag portions produced have smooth horizontal parting surfaces which mate when the cope and drag portions are joined to form a composite sand mold. Molten metal cannot seep between the cope and drag portions which would otherwise have to be removed by machining after hardening. Another important advantage relates to the fact that a drag portion eventually rests on its surface which has been leveled and compacted. Since this surface is smooth and horizontal, the composite sand mold is stable, i.e. it does not tilt or rock. If the composite sand mold tilts or rocks while molten metal is being poured into it, the metal can miss the pouring hole in the mold.

U.S. Pat. No. 400,893 discloses an apparatus for leveling and compacting sand in an open-top mold box. The box is conveyed underneath a pair of rollers which extend transversely of the direction of travel of the mold box. The first roller which contacts the sand is positioned slightly higher than the second roller. The first roller levels the sand before it is further leveled and compacted by the second roller. The surface of the first roller is made of rubber or other resilient material to prevent hard chunks from interfering with the leveling and compacting. Leveler blades are mounted after each roller. Mechanisms are provided for independently adjusting the height of the rollers. The axles of the rollers are mounted in journal boxes which have spring mechanisms but it is not clear whether the rollers are biased downwardly against the sand. Gear mechanisms rotate the rollers in the same direction. The rollers could be made to rotate against the direction of travel of the mold box, although this is not clear from the patent.

U.S. Pat. No. 1,759,728 discloses a similar apparatus which employs a pair of rollers for leveling and compacting sand in an open-top mold box. The first roller is positioned higher than the second roller whose lower periphery is at the same height as the top edges of the mold box. The rollers rotate so that their lower peripheries travel in the same direction as the direction of travel of the mold box passing thereunder. The axle of the first roller is journaled in two bearings whose height can be vertically adjusted. The axle of the second roller is pivotally mounted on the axle of the first roller, however, the height of the second roller is apparently fixed during the leveling and compacting operation by adjustable rods.

Neither of the aforementioned patented apparatus is adapted for automatically leveling and compacting sand in mold boxes of varying heights carried in succession along a pathway. The rollers of each must be manually adjusted to a precise height if a mold box is to be run thereunder which has a different height than the immediately preceding mold box.

SUMMARY OF THE INVENTION

It is an object of the present invention to provide a strike off apparatus for automatically leveling and compacting sand in mold boxes of varying heights carried in succession along a pathway.

It is another object of the present invention to provide a strike off apparatus with raisable and lowerable rollers and an elevating mechanism for adjusting the height of the rollers.

It is another object of the present invention to provide a strike off apparatus having an improved roller assembly for leveling and compacting sand in mold boxes of varying heights carried in succession along a pathway.

It is yet another object of the present invention to provide a strike off apparatus having pivotally mounted rollers adapted to swing toward and away from a mold box carried thereunder and further having a mechanism for biasing the rollers against the sand in the mold box.

It is still a further object of the present invention to provide a strike off apparatus for leveling and compacting sand in mold boxes of varying heights carried in succession along a pathway, the apparatus having a control system for automatically controlling its cyclical operation.

The present invention provides an apparatus for leveling and compacting sand in mold boxes of varying heights carried in succession along a pathway. The apparatus includes roller means extending across the pathway for leveling and compacting sand in a mold box carried thereunder. It also includes sensing means for determining a height having a predetermined relation to the height of the mold box before the mold box reaches the roller means. The apparatus further includes elevating means responsive to the sensing means for adjusting the roller means to a height so that the roller means levels and compacts the sand in the mold box as the box is carried thereunder.

BRIEF DESCRIPTION OF THE DRAWINGS

FIG. 4 is an elevational view of the strike off apparatus of FIG. 3 taken along line 4—4 of FIG. 3. The rollers of the strike off apparatus have been lowered to their lower limit of movement;

FIG. 5 is an enlarged elevational view of the end of the roller assembly of the strike off apparatus of FIG. 3 taken along line 5—5 of FIG. 3. The infrared proximity sensor and its mounting bracket have been omitted;

FIG. 6 is a functional diagram showing the manner in which the rollers of the strike off apparatus of FIG. 3 level and compact the sand contained in a mold box which is conveyed thereunder;

FIG. 8 is a schematic diagram of the hydraulic circuit forming a part of the control system of the strike off apparatus of FIG. 3.

DESCRIPTION OF THE PREFERRED EMBODIMENT

Figure 1:
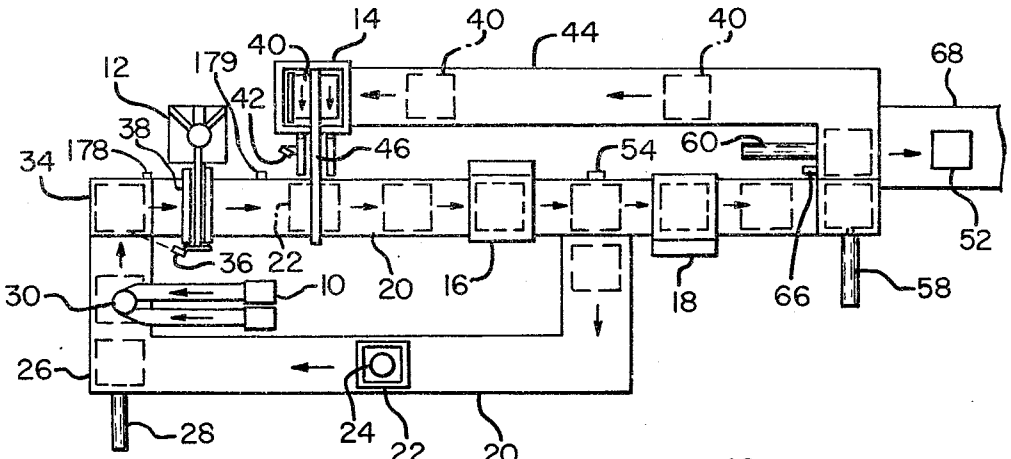
FIG. 1 shows a simplified plan view of a multistation sand mold making apparatus which utilizes one embodiment of the strike off apparatus of the present invention.
Figure 2A:
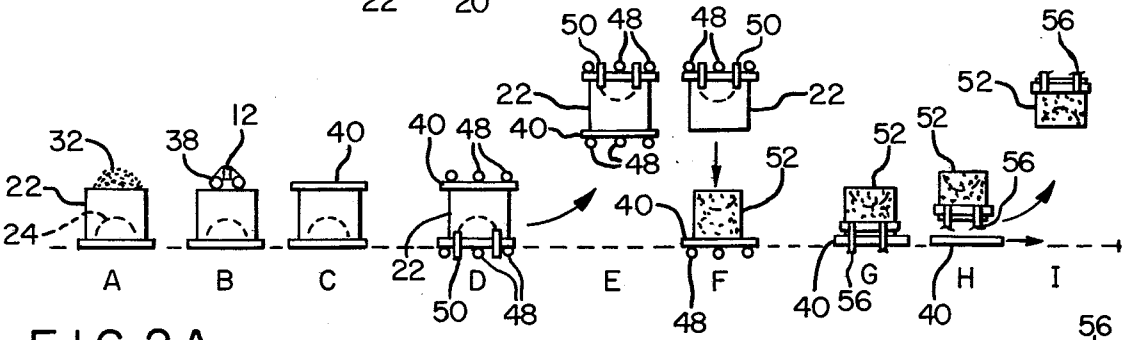
FIG. 2A shows a functional diagram illustrating the manner in which the multi-station sand mold making apparatus of FIG. 1 forms a cope portion of a composite sand mold.
Figure 2B:
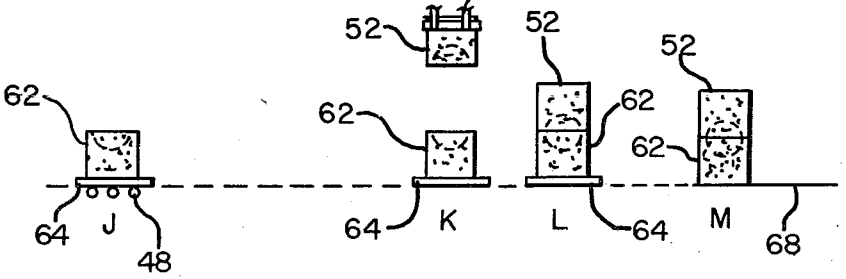
FIG. 2B shows a functional diagram illustrating the manner in which the multi-station sand mold making apparatus of FIG. 1 joins a cope portion and a drag portion to form a composite sand mold.

Referring to FIGS. 1, 2A and 2B, a mixer 10, a strike off apparatus 12 constructed in accordance with the present invention, a bottom board feeder apparatus 14, a roll over draw apparatus 16, and a roll over close apparatus 18 are stationed successively along a pathway or main conveying line 20 of intermittently powered conveying rollers. A plurality of open-top mold boxes of varying heights such as 22, being alternately cope and drag boxes, travel in a clockwise direction around the main conveying line 20. Each mold box contains a pattern such as indicated at 24.

First described will be the formation of a cope portion of a mold. When the mold box 22 reaches the corner 26 of the main conveying line 20 a pneumatic cylinder 28 pushes the mold box beneath the discharge end 30 of the mixer 10. A predetermined amount of sand 32 containing a binder and a catalyst is automatically poured into the mold box (FIG. 2A, step A). The mold box is simultaneously vibrated to eliminate voids and produce some compaction of the sand. The amount of sand which is poured into the mold box is sufficient to form a mound which extends above the upper edges of the box.

Next, the mold box 22 containing the mound of sand 32 is conveyed to a corner 34 of the main conveying line 20 where it momentarily stops. After a time delay, the mold box 22 leaves the corner 34 and travels toward the strike off apparatus 12. As infrared proximity sensor 36, mounted on an assembly supporting a pair of rollers 38, is activated. At this point the rollers 38 are at their upper limit of movement and an elevating mechanism lowers the roller assembly, and the sensor 36 until its horizontal scanning beam is intercepted by the mound of sand 32 in the mold box. This is done before the box reaches the rollers. The rollers 38 stop at a height so that they ride over the sand in the mold box as the box passes thereunder. The sand is leveled and slightly compacted by the rollers. After the mold box has passed under the rollers, they are raised to their original positions and the apparatus awaits the next succeeding box.

Next, the mold box 22 is conveyed along the pathway 20 to the bottom board feeder apparatus 14 where it momentarily stops in position for receiving a bottom board such as 40. An infrared proximity sensor 42 mounted on the board elevating mechanism of the bottom board feeder apparatus senses the presence of the mold box 22. The bottom board 40 has already been conveyed along a return conveying line 44 of intermittently powered conveying rollers onto the bottom board feeder apparatus 14. The elevating mechanism of the bottom board feeder apparatus raises the bottom board 40 until the horizontal scanning beam of the sensor 42 is above the upper surface of the mold box 22. Thereafter, a shuttle mechanism 46 of the bottom board feeder apparatus feeds the bottom board laterally onto the top of the mold box (FIG. 2A, step C).

Next, the mold box 22, now covered with a bottom board 40, is conveyed along the main conveying line 20 to the roll over draw apparatus 16. The mold box 22 and the bottom board 40 are clamped between jaws of rollers 48 and arms 50 grip the bottom flange of the mold box (FIG. 2A, step D). The mold box 22 and the bottom board 40 are inverted, i.e. rolled over 180 degrees (FIG. 2A, step E). The now hardened cope portion 52 of the sand mold is lowered out of the mold box 22 with the aid of vibrating mechanisms by unclamping the jaws of rollers 48. (FIG. 2A, step F). The cope portion 52 and the bottom board 40 upon which it now rests are conveyed out of the roll over draw apparatus 16 and along the main conveying line 20 to the roll over close apparatus 18.

After the cope portion 52 and the bottom board 40 are conveyed out of the roll over draw apparatus 16, the mold box 22 is clamped between the rollers 48 and re-inverted, i.e. rolled over 180 degrees. The mold box 22 is then conveyed out of the roll over draw apparatus 16 to a box return mechanism 54 positioned between the roll over draw apparatus 16 and the roll over close apparatus 18. The mechanism 54 ejects the mold box 22 laterally and the mold box is returned along the main conveying line 20 to its original starting place.

Arms 56 of the roll over close apparatus 18 clamp the cope portion 52 and raise it off of the bottom board 40 (FIG. 2A, steps G and H). The bottom board 40 is conveyed out of the roll over close apparatus 18 to a position adjacent a pneumatic cylinder 58 which pushes the board laterally to a position adjacent a pneumatic cylinder 60. After the bottom board 40 is conveyed out of the roll over close apparatus 18, the cope portion 52 is inverted, i.e. rolled over 180 degrees (FIG. 2A, step I). The cope portion 52 is maintained in an elevated position above the level of the main conveying line 20 awaiting the arrival of a drag portion.

In a similar fashion, the multi-station sand mold making apparatus shown in FIG. 1 produces the drag portion 62 of the composite sand mold (FIG. 2B, step J), the steps being the same as steps A through F (FIG. 2A). The drag portion 62 and the bottom board 64 upon which it rests are then conveyed into the roll over close apparatus 18 directly underneath the waiting cope portion 52 (FIG. 2B, step K). The cope and drag portions 52 and 62 are joined (FIG. 2B, step L) and they are conveyed, resting on top of the bottom board 64, out of the roll over close apparatus 18 to a position adjacent the pneumatic cylinder 58. The pneumatic cylinder 58 pushes the bottom board 64, and the cope and drag portions 52 and 62 carried thereby, laterally to a position adjacent the the pneumatic cylinder 60. The bottom board 64 pushes the bottom board 40 onto the return conveying line 44 and the powered conveying rollers thereof convey the bottom board 40 back to the bottom board feeder apparatus 14. An infrared proximity sensor 66 senses the presence of the completed sand mold and actuates the pneumatic cylinder 60 which pushes the joined cope and drag portions 52 and 62 down a chute 68 which leads to a metal pouring station (FIG. 2B, step M). The next succeeding bottom board that is pushed laterally by the pneumatic cylinder 58 will push the bottom board 64 laterally onto the return conveying line 44 which will return it to the bottom board feeder apparatus 14.

In actual operation a plurality of mold boxes and bottom boards are simultaneously circulated about the apparatus shown in FIG. 1. A continuous succession of composite sand molds assembled and ready for the molten metal pouring operation is produced.

Figure 3:
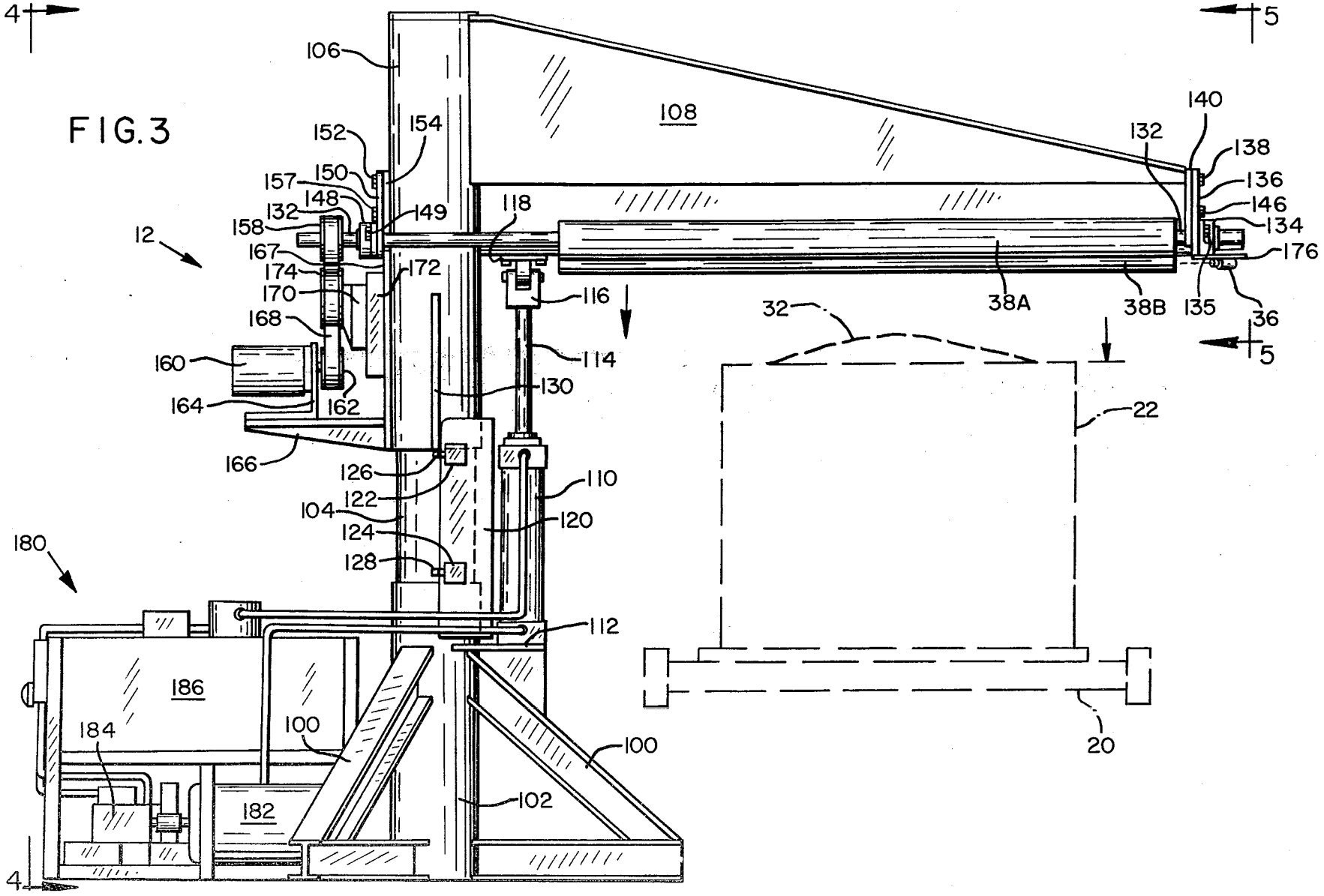
FIG. 3 is an enlarged elevational view of the strike off apparatus shown in FIG. 1. A mold box and a portion of the main conveying line are shown in phantom lines. The rollers of the strike off apparatus have been raised to their upper limit of movement.

Referring to FIG. 3, the illustrated embodiment of the strike off apparatus 12 of the present invention includes a tripod base 100 which includes a central, vertically extending cylindrical base 102. A cylindrical guide 104 extends vertically from the cylindrical base 102. A vertically extending cylindrical sleeve 106 fits over the cylindrical guide 104 and is adapted to slide upwardly and downwardly about the guide 104 in telescoping fashion.

A horiztonal arm 108 is attached to the sleeve 106 and extends across the conveying line 20. The sleeve 106 and the arm 108 support the rollers 38 as will later be described. A vertically extending hydraulic cylinder 110 is mounted on a horizontally extending flange 112 secured to the cylindrical base 102. The piston rod 114 of the hydraulic cylinder 110 is attached to a fork 116 which is bolted to a bracket 118 secured to the underside of the arm 108. The extension and retraction of the piston rod 114 raises and lowers the sleeve 106 and the arm 108, and the rollers 38 carried thereby.

The lower portion of a vertically extending curved mounting plate 120 is attached to the cylindrical base 102. The upper portion of the plate 120 is spaced from the sleeve 106. A normally open upper limit switch 122 and a normally closed lower limit switch 124 are mounted on the edge of the plate 120. The switches 122 and 124 are closed and opened respectively when their cam followers 126 and 128 engage a vertically extending cam 130 attached to the side of the sleeve 106. The switches 122 and 124 limit the upward and downward travel of the sleeve 106, the arm 108, and the rollers 38, as will be explained later on in greater detail.

The rollers 38 are supported by the sleeve 106 and the arm 108 and extend horizontally across the path of travel of the mold box 22. They have a length which is greater than the width of the mold box. The rollers are preferably made of a resilient material such as polyurethane. The resiliency of the rollers reduces the wear on the rollers and on the upper edges of the mold boxes which occurs after long periods of use. Polyurethane is preferred because the sand containing the binder and catalyst will not stick to the rollers. This eliminates the necessity of cleaning the rollers after each leveling and compacting operation.

The rollers 38 are mounted on axles 132 which extend on opposite sides of the sleeve 106. The ends of axles 132 remote from the sleeve 106 are journaled in bearings 134 (FIGS. 3 and 5) secured by bolts 135 to the bases of triangular support plates 136. The innermost of the bolts 135 are secured to the triangular support plates 136 through vertically extending arcuate apertures 137 (FIG. 5) which extend through the plates 136.

The apexes of the triangular support plates 136 are pivotally secured by bolts 138 (FIGS. 3 and 5) to a plate 140 mounted on the remote end of the arm 108. The triangular support plates 136 each have horizontally extending arcuate apertures 142 (FIG. 5) therethrough. Bolts 146 secured to the plate 140 slide in the apertures 142 and limit the pivotal movement of the plates 136.

In a similar fashion the other ends of the axles 132 are journaled in bearings 148 (FIG. 3) secured by bolts 149 to the bases of triangular support plates 150 (FIGS. 3 and 4). The innermost of the bolts 149 are secured to the triangular support plates 150 through vertically extending arcuate apertures 151 (FIG. 4) which extend through the plates 150. The height of the rollers 38 relative to each other can be adjusted by untightening the bolts 135 and 149, pivoting the bearings 134 and 148 by sliding the innermost of the bolts 135 and 149 in the apertures 137 and 151 respectively, and then retightening the bolts 135 and 149.

The first roller 38A which is the first to contact the sand 32 in the mold box 22, is preferably positioned so that its lower periphery is slightly above the upper edges of the mold box after the rollers 38 have been lowered as will be described later on. The second roller 38B is preferably positioned so that its lower periphery is slightly below the upper edges of the mold box 22 after the rollers 38 have been lowered. The reason for positioning the rollers 38A and 38B in this manner is described later on.

The apexes of the triangular support plates 150 are pivotally secured by bolts 152 (FIGS. 3 and 4) to a plate 154 secured to the sleeve 106. The triangular support plates 150 have horizontally extending arcuate apertures 156 (FIG. 4) therethrough. Bolts 157 (FIG. 3) secured to the plate 154 slide in the apertures 156 to limit the pivotal movement of the plates 150. Since the support plates 136 and 150 are pivotally mounted, the rollers 38 can swing toward and away from the mold box as it is carried under the rollers.

Pulleys 158 (FIGS. 3 and 4) are mounted on the ends of the axles 132. A hydraulic motor 160 having a pulley 162 (FIG. 3) mounted on its drive shaft, is mounted to an L-shaped bracket 164 attached to a horizontally extending support base 166 secured to the lower periphery of a plate 167 secured to the sleeve 106. The motor 160 is drivingly connected with the rollers 38 by a belt 168 (FIGS. 3 and 4) which rides in the pulleys 158 and 162. The rollers 38 are preferably rotated in a counter-clockwise direction (FIG. 6) so that their lower peripheries move in an opposite direction to the direction of travel of the mold box 22. This counter-rotation more evenly distributes the sand in the box.

One end of an arm 170 (FIGS. 3 and 4) is rotatably mounted to a housing 172 mounted to the plate 167. The other end of the arm 170 rotatably supports an idler pulley 174. The housing 172 contains an internal spring mechanism (not shown in the drawings) which urges the pulley 174 in a counter-clockwise direction against the belt 168 so that the belt is tightened and rides in the pulley 174. The rollers 38 are thus biased downwardly and can swing upwardly when enough force is exerted against them to cause the pulley 174 to swing in a clockwise direction (FIG. 4).

The infrared proximity sensor 36 (FIGS. 1 and 3) is mounted on a bracket 176 (FIG. 3) attached to the plate 140. The sensor 36 is aimed so that its scanning beam extends horizontally between the lower peripheries of the rollers 38A and 38B (FIG. 3) across the conveying line 20 (FIG. 1).

Referring to FIG. 1, a normally open box approaching limit switch 178 is mounted on the edge of the conveying line 20 in advance of the strike off apparatus 12. The switch 178 is closed when the mold box 22 leaves the corner 34 and approaches the strike off apparatus. Preferably, the switch 178 remains closed until the mold box 22 reaches the rollers 38 at which time it opens. A normally open box departing limit switch 179 is mounted on the edge of the conveying line 20 after the strike off apparatus 12. The switch 179 is closed after the mold box 22 has passed beneath the rollers 38.

A power unit generally designated 180 (FIG. 3) is positioned adjacent the tripod base 100. It contains a three-phase induction motor 182 which is drivingly coupled to a hydraulic pump 184. The hydraulic pump 184 pumps hydraulic fluid from a hydraulic fluid tank contained within a housing 186 through the hydraulic circuit shown in FIG. 8.

The leveling and compacting operation of the strike off apparatus will now be described. As shown in FIG. 3 the mold box 22, regardless of its height, has been filled with sand 32 to produce a mound whose peak is higher, e.g. 3 or 4 inches, than the upper edges of the mold box. When the mold box 22 leaves the corner 34 of the conveying line 20, the rollers 38 are lowered from their upper limit of movement shown in FIG. 3 until the scanning beam of the sensor 36 is intercepted by the mound of sand 32.

Preferably, the sensor 36 is aimed across the conveying line 20 so that its beam is initially intercepted by a portion of the mound which is adjacent an upper edge of the mold box. The upper periphery of this portion of the mound is slightly higher than the upper edges of the mold box. The vertical position of the sensor 36 relative to the rollers is such that the rollers stop descending when the lower periphery of the first roller 38A is above the upper edges of the mold box and the lower periphery of the second roller 38B is below the upper edges of the mold box.

Alternatively, the sensor 36 can be aimed across the conveying line 20 so that its beam is initially intercepted by an upper edge of the mold box rather than by the sand mound. In this case the sensor would have to be vertically adjusted relative to the rollers so that the rollers stop descending relative to the mold box in the positions just described.

In any case before the mold box reaches the rollers the sensor 36 detects an upper periphery of the mold box and the sand therein and determines a height which has a predetermined relation to the height of the mold box. The rollers are thereby lowered to a height which will produce the desired leveling and compacting hereafter described. If the mold box 22 is lowered on the conveying line before it reaches the rollers 38, but after the rollers have already descended, the rollers will descend a second time to compensate for the lowering of the mold box.

Referring to FIG. 6, as the mold box 22 is carried underneath the rollers the first roller 38A levels and slightly compacts the sand 32 in the mold box. The second roller 38B swings upwardly and rides along the upper edges of the mold box. If further compacts the sand and imparts a smooth, horizontal surface which coincides with the upper edges of the mold box. The compaction of the sand occurs as a result of the downward biasing force of the rollers supplied by the pulley 174 pressing against the belt 168. After the leveling and compacting operation the sand 32 has a uniform density. The counter rotation of the rollers helps to evenly distribute the sand. Excess sand falls away from the mold box and is reclaimed.

Because the rollers 38 can swing toward and away from the mold box, they do not have to be lowered to a precise height relative to the upper edges of the mold box. So long as the second roller 38B will press against the upper edges of the mold box satisfactory results can be achieved.

Figure 7:
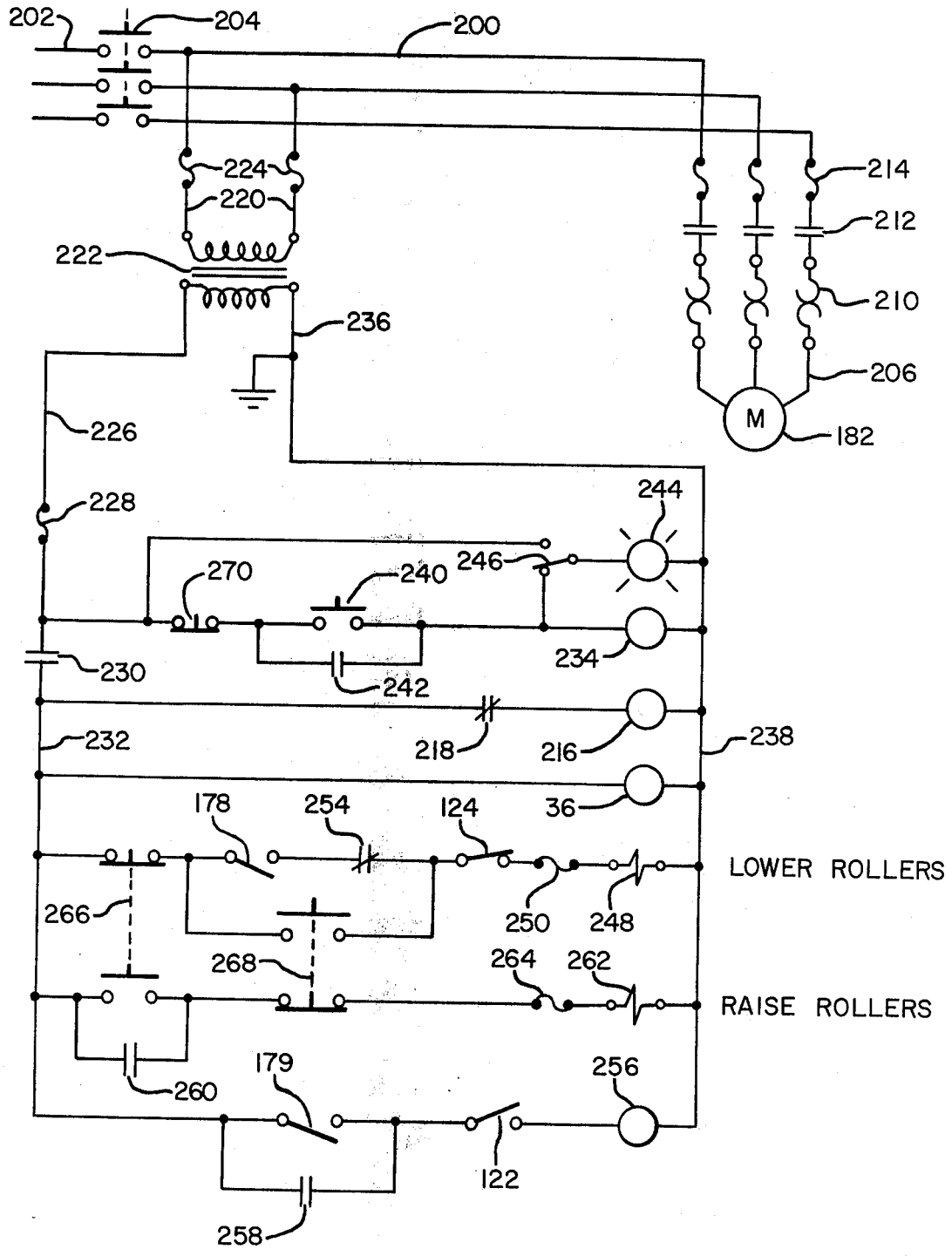
FIG. 7 is a schematic diagram of the electrical circuit forming a part of the control system of the strike off apparatus of FIG. 3.

The automatic operation of the strike off apparatus 12 will now be described in connection with an explanation of its control system which includes electrical and hydraulic circuits shown in FIGS. 7 and 8. Referring to FIG. 7, conductors 200 are connected to electric lines 202 by throwing a manual circuit breaker switch 204. The electric lines 202 are connected to a 60 Hertz, three phase, AC electric power source.

The leads 206 of the three phase induction motor 182 which drives the hydraulic fluid pump 184 are each connected to one terminal of individual melting alloy units 210. The other terminals of the melting alloy units 210 are each connected to relay contacts 212 which are in turn connected to the conductors 200 through fuses 214. The relay contacts 212 are associated with a relay winding 216.

The melting alloy units 210 are mechanically ganged. During the operation of the strike off apparatus, if any one of the units 210 melts due to an overload or phase loss, all of them will melt. This will cause contacts 218 to open, thereby de-energizing the relay winding 216 and causing the relay contacts 212 to open. The motor 182 will thus be protected from damage due to overload or phase loss.

The leads 220 of the primary winding of a transformer 222 are connected to two of the conductors 200 through fuses 224. One lead 226 of the secondary winding of the transformer 222 is connected through a fuse 228 and through relay contacts 230 to a bus generally designated 232. The relay contacts 230 are associated with a master control relay winding 234. The other lead 236 of the secondary winding of the transformer 222 is grounded and is connected to a bus generally designated 238. The remaining components of the electrical circuit are connected between the buses 232 and 238.

The strike off apparatus 12 is started by depressing a momentary switch 240 which causes the master control relay winding 234 to be energized. This in turn causes the relay contacts 230 and 242 associated with the master control relay winding 234 to close. The relay winding 216 is energized which closes the relay contacts 212. The motor 182 is energized and hydraulic fluid begins to flow through the hydraulic circuit. The hydraulic motor 160 is driven and the rollers 38 are rotated.

As soon as the momentary switch 240 is depressed, an indicator lamp 244 lights up to indicate that the strike off apparatus is in its "power on" mode. If the lamp 244 does not light up when the switch 240 is depressed, a testor switch 246 can be manually thrown. If the lamp 244 lights up the relay winding 234 and the relay contacts 242 should be checked for defects.

As soon as the relay contacts 230 close, the infrared proximity sensor 36 is energized. At this point the rollers 38 are positioned at their upper limit of movement. The upper limit switch 122 is open and the lower limit switch 124 is closed.

When the mold box 22 closes the box-approaching limit switch 178, a solenoid 248 protected by a fuse 250 is energized. The solenoid 248 shifts a four way, three position, spring centered, hydraulic fluid valve 252 (FIG. 8) so that hydraulic fluid flows into the hydraulic cylinder 110 and causes the piston rod 114 to retract and the rollers 38 to descend. The upper limit switch 122 closes.

When the horizontal scanning beam of the sensor 36 is intercepted by the sand 32 in the mold box 22 the sensor opens relay contacts 254 (FIG. 7). The solenoid 248 is de-energized and since the valve 252 (FIG. 8) is spring centered it switches back to its middle position. When the valve 252 is in this position, hydraulic fluid cannot flow into or out of the hydraulic cylinder 110. The piston rod 114 and the rollers 38 stop moving. When the mold box 22 reaches the rollers 38 the box-approaching limit switch 178 opens. The mold box 22 is conveyed along the main conveying line 20 underneath the rollers 38 which level and slightly compact the sand 32 in the mold box, leaving a smooth, horizontal surface. Excess sand falls away from the mold box.

When the mold box 22 closes the box-departing limit switch 179 (FIG. 7) a relay winding 256 is energized which closes relay contacts 258 and 260. The closing of the relay contacts 260 causes a solenoid 262 protected by a fuse 264 to be energized. The solenoid 262 shifts the valve 252 (FIG. 8) so that hydraulic fluid flows into the hydraulic cylinder 110 and causes the piston rod 114 to extend and the rollers 38 to rise.

When the rollers 38 reach their upper limit of movement the upper limit switch 122 (FIG. 7) is opened which de-energizes the relay winding 256. The relay contacts 258 and 260 open. The solenoid 262 is de-energized and the valve 252 (FIG. 8) shifts back to its middle position. The piston rod 114 stops extending and the rollers 38 stop rising, having now returned to their original positions. The mold box 22 continues to move along the main conveying line 20 and eventually the box-departing limit switch 179 opens. This completes the cycle of operation. The strike off apparatus 12 is now ready to level and compact the sand in the next succeeding mold box.

If the box-approaching limit switch 178 (FIG. 7) should accidentally be closed, e.g. when no mold box has left the corner 34 of the main conveying line 20, the rollers 38 will descend until the lower limit switch 124 is opened. When the lower limit switch 124 is opened, the solenoid 248 will be de-energized and the valve 252 (FIG. 8) will shift to its middle position. The lower limit switch 124 (FIG. 7) prevents the rollers 38 from descending too low which might result in damage to the apparatus.

Momentary switches 266 and 268 may be depressed to override the automatic operation and cause the rollers to rise or descend, respectively. A momentary switch 270 may be depressed to place the strike off apparatus into its "power off" mode. This may be done at the conclusion of any number of cycles, or during a cycle in case of an emergency.

Referring to FIG. 8, the hydraulic circuit also includes a pressure release valve 272 which protects the components of the hydraulic circuit if potentially damaging high fluid pressure should arise. The hydraulic fluid is routed through a variable flow control valve 274. The valve 274 may be adjusted to vary the amount of hydraulic fluid which is bypassed directly into the hydraulic fluid tank in the housing 186. This will in turn vary the speed at which the piston rod 114 will extend and retract and the speed at which the rollers 38 will rise and descend. It will also vary the speed at which the rollers 38 rotate. This speed must be adjusted to obtain the best results. A meter 276 indicates hydraulic fluid pressure.

It is apparent that many modifications and variations may be made in the invention. For example, photoelectric, magnetic, or other proximity sensing mechanisms may be substituted for the infrared sensor 36. Solid state switching circuits may be substituted for the relay control circuit shown in FIG. 7. The strike off apparatus and the other apparatuses making up the successive stations of the multi-station sand mold making apparatus may be simultaneously controlled by a central, solid state programmable control system. An electric motor and gear drive mechanism may be substituted for the hydraulic cylinder. If mold boxes of uniform height are to be utilized in the multi-station sand mold making apparatus, the proximity sensor can be eliminated and the rollers do not have to be mounted on a vertically movable support. However, such modifications and adaptations, as well as others, are within the spirit and scope of the present invention.

What is claimed is:

1. A method of leveling and compacting mounds of sand extending above the upper edges of a plurality of open-top mold boxes of varying heights carried in succession along a pathway, comprising:

determining the vertical position of upper edges of an open-top mold box carried along a pathway, said mold box carrying a mound of sand extending higher than said upper edges of said mold box;

lowering a pair of rollers from a first vertical position substantially above said mound of sand in said mold box to a second vertical position adjacent said determined vertical position of said upper edges of said mold box, said pair of rollers comprising first and second rollers whose axes extend transversely of the direction of travel of said mold box along said pathway, said rollers each having a length greater than the width of said mold box, said rollers being pivotally supported wherein they can swing toward and away from said mold box, said first roller being positioned higher than said second roller, said rollers being adapted to rotate whereby their lower peripheries move in a direction opposite to the direction of travel of said mold box along said pathway, said rollers being biased toward said mold box, said second vertical position being one wherein the lower periphery of said first roller is above said upper edges of said mold box and the lower periphery of said second roller is below said upper edges of said mold box;

passing said mold box along said pathway beneath said rollers whereby said first roller levels and compacts said mound of sand to a height above said upper edges of said mold box and said second roller contacts the front of said mold box, swings upwardly and rides along said upper edges of said mold box further to compact said mound of sand and impart a smooth horizontal surface thereto, said surface coinciding with said upper edges of said mold box; and raising said pair of rollers to said first vertical position after said mold box has passed therebeneath.

* * * * *